US007653178B2

(12) United States Patent
Ohsawa

(10) Patent No.: US 7,653,178 B2
(45) Date of Patent: Jan. 26, 2010

(54) X-RAY GENERATING METHOD, AND X-RAY GENERATING APPARATUS

(75) Inventor: Satoshi Ohsawa, 1-12-2, Otsutominami, Tsuchiura City, Ibaraki (JP) 303-0845

(73) Assignees: Satoshi Ohsawa, Tsuchiura (JP); Noriyoshi Sakabe, Tsuchiura (JP)

( * ) Notice: Subject to any disclaimer, the term of this patent is extended or adjusted under 35 U.S.C. 154(b) by 50 days.

(21) Appl. No.: 12/071,373

(22) Filed: Feb. 20, 2008

(65) Prior Publication Data

US 2009/0122961 A1 May 14, 2009

Related U.S. Application Data

(63) Continuation-in-part of application No. 11/204,967, filed on Aug. 17, 2005, now Pat. No. 7,359,485.

(30) Foreign Application Priority Data

Aug. 20, 2004 (JP) ..... 2004-241301

(51) Int. Cl.
*H01J 35/14* (2006.01)

(52) U.S. Cl. ..... 378/138; 378/137

(58) Field of Classification Search ..... 378/137, 378/138, 129, 119, 121, 125
See application file for complete search history.

(56) References Cited

U.S. PATENT DOCUMENTS

| | | | | |
|---|---|---|---|---|
| 4,130,759 | A | | 12/1978 | Haimson |
| 4,389,572 | A | | 6/1983 | Hutcheon |
| 4,392,235 | A | | 7/1983 | Houston |
| 5,060,254 | A | | 10/1991 | de Fraguier et al. |
| 5,267,294 | A | * | 11/1993 | Kuroda et al. ..... 378/65 |
| 5,680,432 | A | | 10/1997 | Voss |
| 5,822,395 | A | | 10/1998 | Schardt et al. |
| 6,091,799 | A | | 7/2000 | Schmidt |
| 6,181,771 | B1 | | 1/2001 | Hell et al. |
| 6,778,633 | B1 | | 8/2004 | Loxley et al. |
| 2003/0058995 | A1 | | 3/2003 | Kutshera et al. |

FOREIGN PATENT DOCUMENTS

| | | |
|---|---|---|
| EP | 0 127 983 A2 | 12/1984 |
| GB | 2 021 310 A | 11/1979 |
| JP | A-01-186739 | 7/1989 |
| JP | A-04-012442 | 1/1992 |
| JP | A-09-158982 | 6/1997 |
| JP | A-11-144653 | 5/1999 |
| JP | A-2002-236907 | 8/2002 |
| JP | A-2003-338258 | 11/2003 |
| JP | A-2004-172135 | 6/2004 |

* cited by examiner

*Primary Examiner*—Hoon Song
(74) *Attorney, Agent, or Firm*—Oliff & Berridge, PLC

(57) ABSTRACT

A method for generating an X-ray includes the steps of: flattening an electron beam with a circular cross section by means of Lorentz force to form a flat electron beam with a flat cross section under the condition so that an intensity of the flat electron beam per unit area can be set higher than an intensity of said electron beam per unit area; and irradiating the flat electron beam onto a target, thereby generating an X-ray.

10 Claims, 3 Drawing Sheets

X-RAY GENERATING METHOD, AND X-RAY GENERATING APPARATUS

CROSS-REFERENCE TO RELATED APPLICATIONS

This application is based upon and claims the benefit of priority from the prior Japanese Patent Applications No. 2004-241301, filed on Aug. 20, 2004 and the prior U.S. patent application Ser. No. 11/204,967, filed on Aug. 17, 2005; the entire contents of which are incorporated herein by reference.

BACKGROUND OF THE INVENTION

1. Field of the Invention

This invention relates to an X-ray generating method and an X-ray generating apparatus.

2. Description of the Related Art

In order to generate high intensity X-rays, it is required to irradiate high density electron beam onto a target. It is difficult, however, to generate a minute focal point onto the target from the high density electron beam because of the large repulsive forces of the electrons of the high density electron beam. In order to mitigate such a problem as not generating the minute focal point, it is proposed to enhance the accelerating voltage of the electrons, but in this case, the electrons are introduced deeply into the target so that the X-rays generated from the deep portions of the target is absorbed into the target and thus, the generating efficiency of the intended X-rays is lowered. When the accelerating voltage is enhanced, the cost of the X-ray generating apparatus may be increased because the X-ray generating apparatus must be insulated entirely.

In Reference 1, referring to the first paragraph in "Summary of the Invention" at col. 1, the invention is directed at providing an X-ray source of type described wherein several different sizes of the X-ray focal spot are possible at low cost. Concretely, referring to FIGS. 2, 3 and the related description at cols. 5 and 6, the electron beam with a spot size of 0.75 mm diameter is elongated into the electron beam with a spot size of 0.5 mm width and 4 mm length.

In this case, the cross section area of the electron beam with the spot size of the 0.75 mm diameter is 0.14 $\pi mm^2$, and the cross section area of the electron beam with the spot size of the 0.5 mm width and the 4 mm length is 0.5 $\pi mm^2$. As a result, the cross section area of the electron beam with the spot size of the 0.5 mm width and the 4 mm length is more than three times as large as the cross section area of the electron beam with the spot size of the 0.75 mm diameter. Therefore, the intensity of the thus obtained electron beam is decreased than the intensity of the original electron beam. In this point of view, in Reference 1, the intensity of the electron beam can not be increased even though the cross section of the electron beam is changed.

Moreover, in Reference 2, referring to FIGS. 4*a* and 4*b* and the related description of col. 5, the electron beam e is deflected out of the spiral plane over an extremely short distance in the Z-direction at the location of the radial field Br. In order to achieve such a deflection, the amplitude of the radial magnetic field is typically significantly larger than that of the axial magnetic field; for example, the axial magnetic field Bz may be 30 G, whereas the radial ejection field Br may be 110 G. At the exit from the Br field, the beam e' focused in the $\phi$-direction and steered onto the anode. However, Reference 2 does not refer to the increase of the intensity of the electron beam.

In Reference 2, FIG. 1 refers to the path of the electron beam in the beam guidance channel, but to the cross section of the electron beam.

[Reference 1] U.S. Pat. No. 6,181,771

[Reference 2] U.S. Pat. No. 5,680,432

BRIEF SUMMARY OF THE INVENTION

It is an object of the present invention to provide a new X-ray generating method and apparatus whereby an electron beam can be focused strongly on a target with a short focusing distance, therefore, a high intensity X-ray can be generated in small area on the target.

In order to achieve the object, the present invention relates to a method for generating an X-ray, including the steps of:

flattening an electron beam with a circular cross section by means of Lorentz force to form a flat electron beam with a flat cross section under the condition so that an intensity of the flat electron beam per unit area can be set higher than an initial intensity of the electron beam per unit area; and irradiating the flat electron beam onto a target, thereby generating an X-ray.

The present invention also relates to an apparatus for generating an X-ray, comprising:

- an electron beam source for generating and emitting an electron beam;
- a flat electron beam-generating means for flattening the electron beam with a circular cross section by means of Lorentz force to form a flat electron beam with a flat cross section so that an intensity of the flat electron beam per unit area can be set higher than an initial intensity of the electron beam per unit area; and
- a target for generating an X-ray by irradiating the flat electron beam thereon.

In the present invention, the flat electron beam with the flat cross section is generated by focusing stronger in a direction than in the other direction by means of Lorentz force of a bending magnet which has a focusing function. Concretely, the normal circular electron beam is flattened against the space charge of the electron beam by means of Lorentz force so as to be flattened. Therefore, since the cross section area of the flat electron beam is set smaller than the cross section area of the circular electron beam, the intensity of the flat electron beam per unit area becomes higher than the intensity of the circular electron beam per unit area. As a result, since the flat electron beam with the higher intensity per unit area can be irradiated onto the target, an X-ray with a higher intensity can be generated from the target.

The flat electron beam can be generated, for example, by a pair of rectangular magnets which are opposed one another and of which edges are cut off to form a tapered edges, respectively, as are shown in FIG. 4. In this case, the electron beam is introduced between the pair of rectangular magnets from the tapered edges, as is shown in FIG. 1.

In the use of the pair of rectangular magnets, for example, a fringing magnetic field is generated out side of the tapered edges of the pair of rectangular magnets so as to be curved outward from the tapered edges. In this case, the Lorentz force in the region of the fringing magnetic field has a horizontal component to focus the beam vertically so as to form the flat electron beam, when the beam is injected against the edge with an angle as is shown in FIG. 1. Actually this focusing force is utilized much more effectively by enlarging the beam vertically before entering the fringing magnetic field region, which automatically focuses the beam horizontally. In this way, this magnetic system has a focusing function originated from the fringing magnetic field, thereby form the flat electron beam.

In Reference 1, since the cross section area of the electron beam is not decreased, the intensity of the electron beam per unit area can not be enhanced, which is different from the present invention. In Reference 2, since the amplitude of the radial magnetic field is typically significantly larger than that of the axial magnetic field; for example, the axial magnetic field Bz may be 30 G, whereas the radial ejection field Br may be 110 G, the Lorentz force can not be applied sufficiently to the electron beam. Therefore, since the cross section area of the electron beam is not decreased, the intensity of the electron beam per unit area can not be enhanced, which is different from the present invention.

In an aspect of the present invention, the target is a rotational target. In this case, since the target can be rotated around the center axis continuously, the electron beam irradiating portion of the target can be cooled down continuously. Therefore, the electron beam with a higher intensity can irradiate onto the target so as to generate the intended X-ray with a higher intensity from the target. Concretely, since the irradiating portion in the rotational target is heated to a temperature near or more than a melting point of the rotational target to be partially melted, the intensity of the X-ray can be more enhanced.

In another aspect of the present invention, the flat electron beam is irradiated onto the inner wall of the rotational target. In this case, the melted portion of the rotational target which is generated by irradiating the flat electron beam onto the rotational target is not splashed because of a centrifugal force generated when the rotational target is rotated.

As described above, according to the present invention can be provided the new X-ray generating method and apparatus whereby the high intensity X-ray can be generated in high efficiency.

BRIEF DESCRIPTION OF THE SEVERAL VIEWS OF THE DRAWINGS

For better understanding of the present invention, reference is made to the attached drawings.

DETAILED DESCRIPTION OF THE INVENTION

Hereinafter, the present invention will be described in detail with reference to the drawings.

Figure 1:
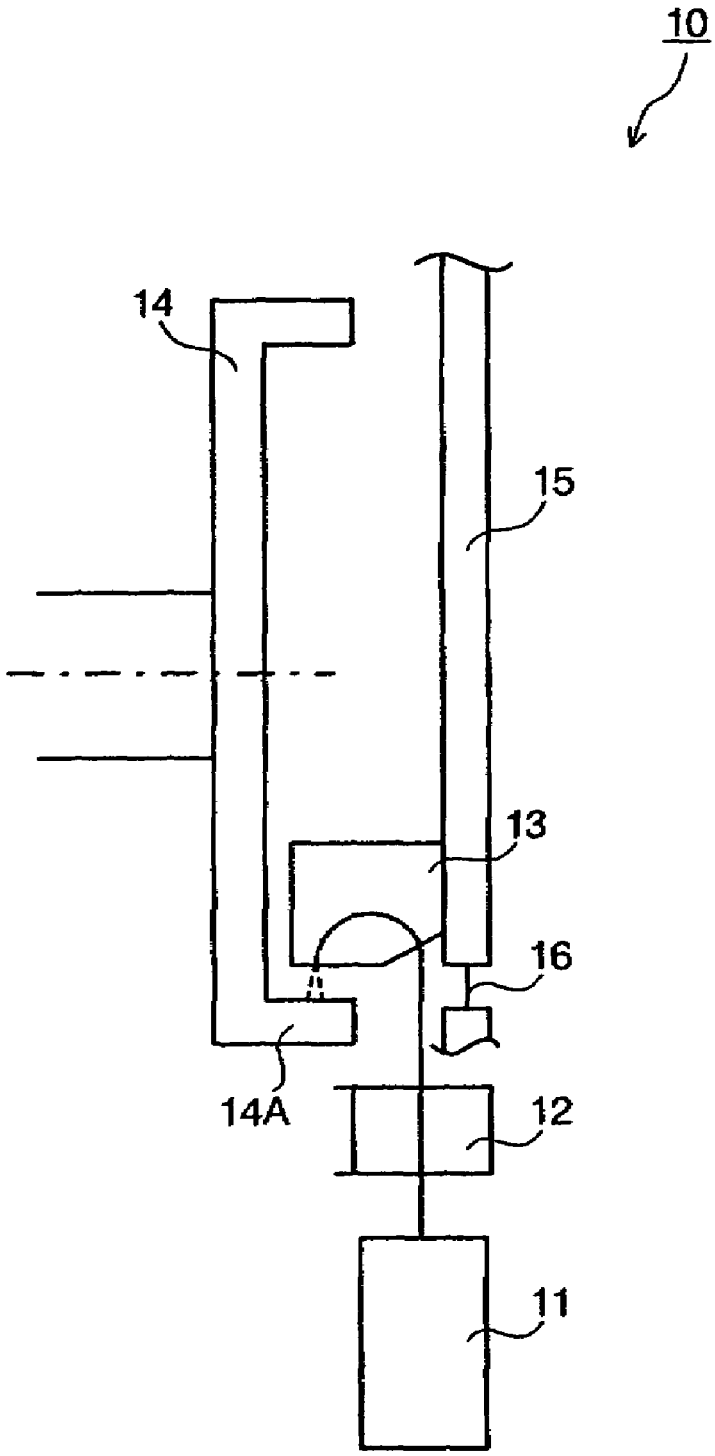
FIG. 1 is a structural view illustrating a main part of an X-ray generating apparatus according to the present invention.
Figure 2:
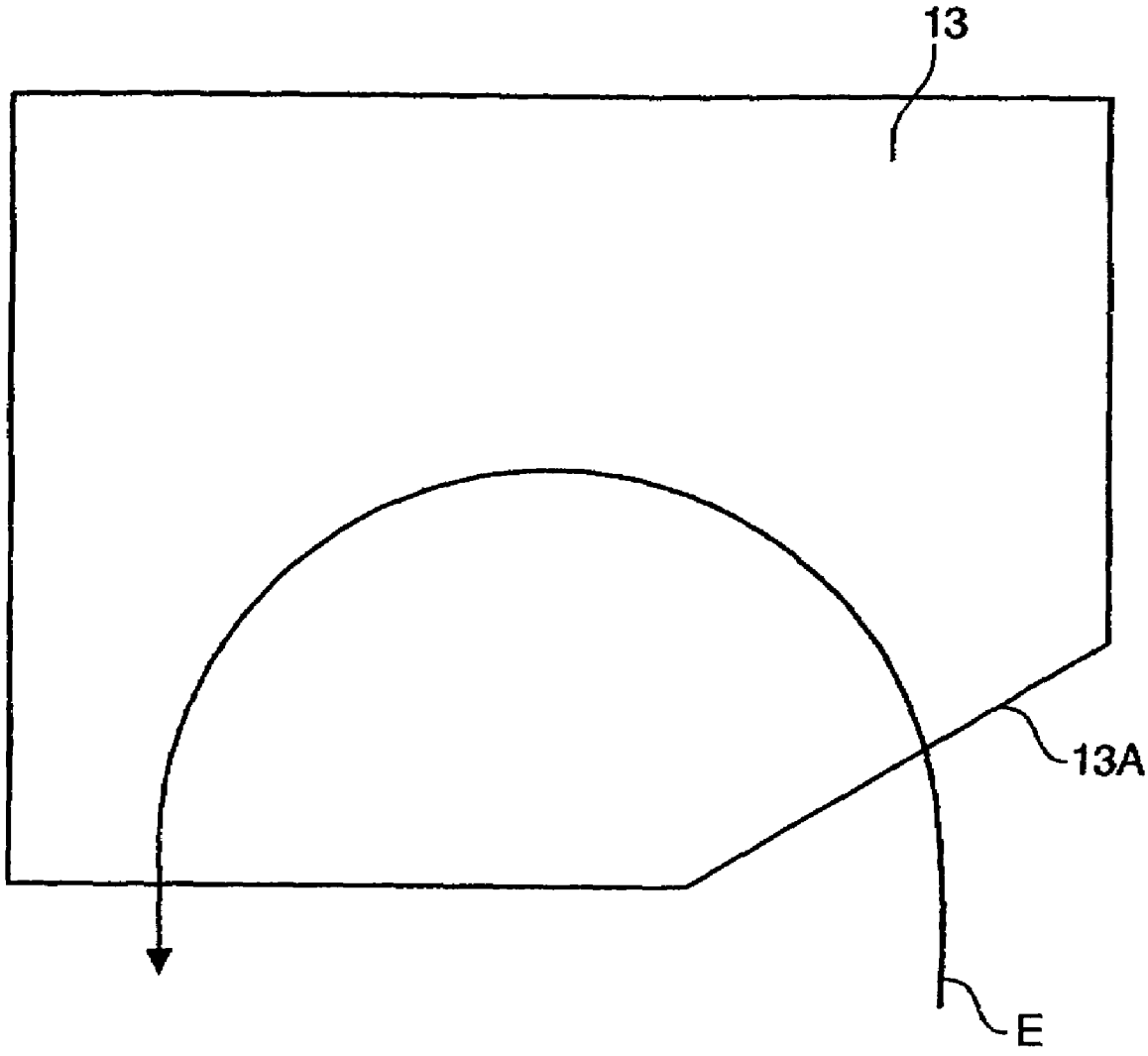
FIG. 2 is a structural view of a pair of magnets of the X-ray generating apparatus illustrated in FIG. 1.
Figure 3:
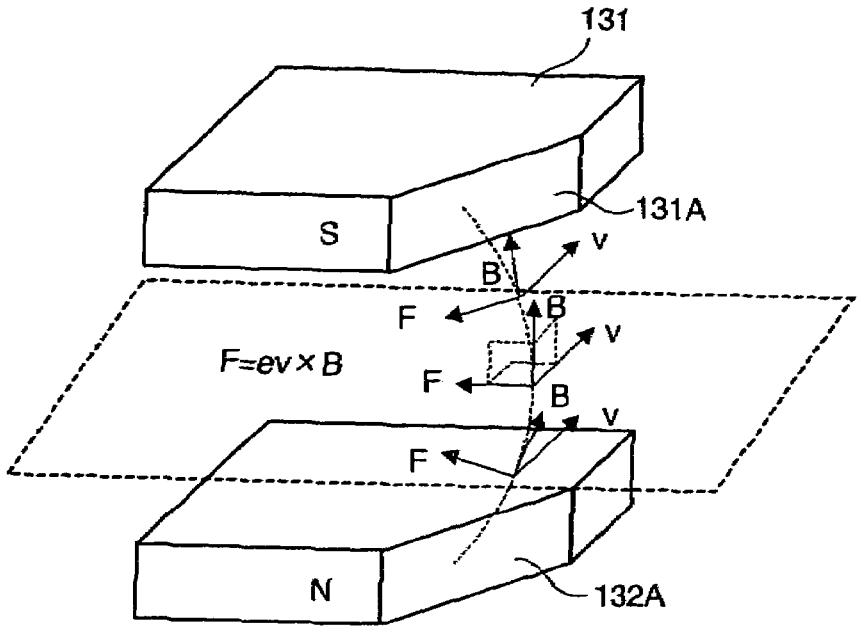
FIG. 3 is a perspective view illustrating a pair of magnets illustrated in FIG. 2.
Figure 4:
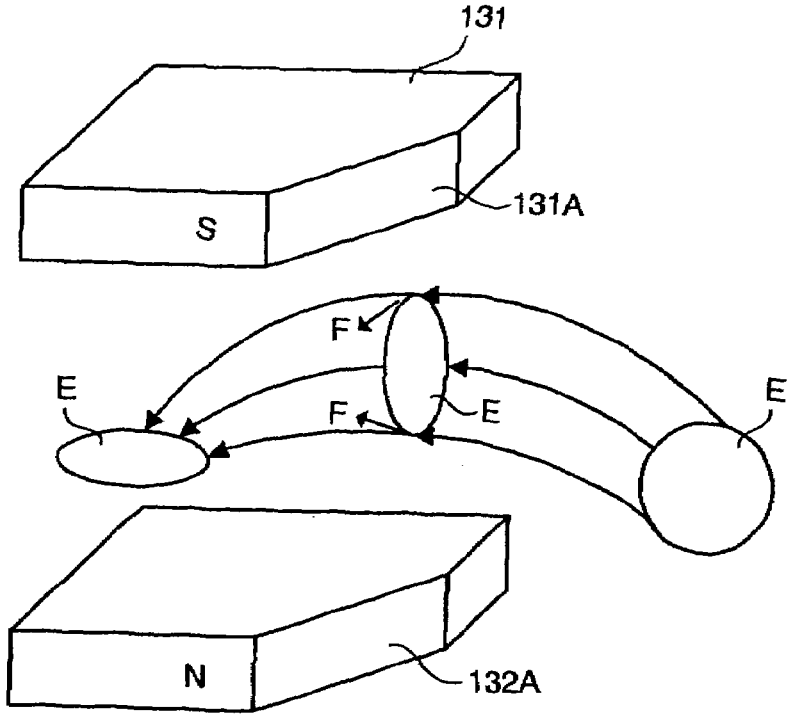
FIG. 4 is a perspective view for explaining the forming process of the flat electron beam using the pair of magnets.

FIG. 1 is a structural view illustrating a main part of an X-ray generating apparatus according to the present invention. FIG. 2 is a structural view illustrating a pair of magnets of the X-ray generating apparatus illustrated in FIG. 1. FIG. 3 is a perspective view of the pair of magnets illustrated in FIG. 2. FIG. 4 is a perspective view for explaining the forming process of the flat electron beam using the pair of magnets.

The X-ray generating apparatus 10 includes an electron gun 11, an electromagnet 12 and a pair of rectangular magnets 13 which are opposed one another as a flat electron beam generating means, and a rotational target 14. The electromagnet 12 may include a quadrupole magnet. The rotational target 14 is joined with a driving motor (not shown) via a driving shaft (not shown) such that the rotational target 14 can be rotated around the central axis I-I. Cooling water is flowed in the rotational target 14 so as to cool down the surface, that is, the irradiating point of the electron beam "E".

The rotational target 14 is disposed in an airtight container 15, and the magnets 13 are attached to the inner wall of the airtight container 15. The interior of the airtight container 15 is evacuated to a given degree of vacuum, e.g., within a pressure range of $10^{-2}$ Pa to $10^{-4}$ Pa, preferably, within $10^{-3}$ Pa to $10^{-4}$ Pa. Throughout the accompanying drawings, the arrow "E" designates (the trace of) the electron beam.

As illustrated in FIGS. 3 and 4, the magnet 13 has an upper rectangular magnet 131 and a lower rectangular magnet 132 which are opposed one another and connected with a return yoke (not shown). Since unnecessary magnetic fields are drawn into the return yoke, an intended fringing magnetic field can be generated effectively and efficiently. As illustrated in FIGS. 2 to 4, then, the edges of the magnets 13 are cut off in the same side to form tapered edges 13A. Namely, the edge of the upper magnet 131 is cut off in the same side as the edge of the lower magnet 132 to form tapered edges 131A and 132A.

The upper magnet 131 of the magnets 13 is set to south pole and the lower magnet 132 of the magnets 13 is set to north pole. Therefore, a magnetic field is generated vertically from the lower magnet 132 to the upper magnet 131. In this case, a flinging magnetic field B is generated at the edges of the magnets 13 so as to be curved outward from the edges as illustrated in FIGS. 3 and 4.

The electron beam "E" emitted from the electron gun 11 is controlled by the electromagnet 12 such that the traveling direction of the electron beam is directed at the magnets 13. In this case, for example, since the electromagnet 12 includes the quadrupole magnet, the cross section of the electron beam "E" is deformed into a vertically enlarged elliptic shape from an initial circular shape. The electron beam "E" with the vertically enlarged elliptic cross section is introduced between the magnets 13 (between upper magnet 131 and lower magnet 132) via the tapered edges 13A (131A and 132A), and passed through the magnet 13.

As shown in FIGS. 3 and 4, in this case, Lorentz forces are generated at the tapered edges 13A (131A and 132A) in dependence on the direction of the electron beam "E" and the direction of the component of the flinging magnetic field B along the tangent line of the curved flinging magnetic field B.

In the upper side (Y>0) of the center surface depicted by the broken line (Y=0), the Lorentz force F(=ev×B) is generated downward so as to be applied downward to the electron beam "E" because the component of the flinging magnetic field B along the tangent line is directed downward. While in the lower side (Y<0) of the center surface depicted by the broken line, the Lorentz force F(=ev×B) is generated upward so as to be applied upward to the electron beam "E" because the component of the flinging magnetic field B along the tangent line is directed upward.

In this way, since the downward Lorentz force and the upward Lorentz force are applied to the electron beam "E" from the upside and the downside of the electron beam "E", respectively, the electron beam can be focused vertically and flattened against the space charge of the electron beam.

In this magnetic system, the initial electron beam "E" with the circular cross section is converted into the electron beam "E" with the vertically enlarged elliptical cross section, and then, focused vertically and flattened. Therefore, the area of the cross section of the flattened electron beam "E" becomes smaller than the area of the cross section of the initial electron beam "E". Therefore, the intensity of the flat electron beam "E" per unit area can be increased than the intensity of the initial circular electron beam "E" per unit area.

In the use of the flat electron beam "E", therefore, since the electron beam "E" with a higher intensity per unit area can be irradiated onto the target in comparison with the circular electron beam "E", the intensity of the thus obtained X-ray can be increased. In other words, a high intensity X-ray can be generated according to the present invention.

Since the downward Lorentz force and the upward Lorentz force depend on the tapered angle of the tapered edges 13A (131A and 132A), the introducing angle of the electron beam "E" and the orbital radius between the magnets 13 (the upper magnet 131 and the lower magnet 132) of the electron beam "E", such parameters as tapered angle, the introducing angle and the orbital radius are appropriately controlled in order to realize the downward Lorentz force and the upward Lorentz force as designed.

In FIG. 1, since the rotational target 14 is employed and rotated around the center axis continuously, the electron beam irradiating portion of the electron beam "E" can be cooled down continuously. Therefore, the flat electron beam "E" with the higher intensity due the reduction in cross section area can be irradiated onto the rotational target 14 so as to generate the intended X-ray with a higher intensity from the target 14. Concretely, since the irradiating portion in the rotational target 14 is heated to a temperature near or more than a melting point of the rotational target 14 to be partially melted, the intensity of the X-ray can be more enhanced.

Moreover, since the flat electron beam "E" is irradiated onto the inner side of the inner wall 14A of the rotational target 14, the melting portions of the rotational target 14 can not be splashed outside by the centrifugal force generated when the rotational target 14 is rotated.

Although the present invention was described in detail with reference to the above examples, this invention is not limited to the above disclosure and every kind of variation and modification may be made without departing from the scope of the present invention.

In the above embodiment, although the rotational target 14 is employed, another type of target may be employed. Moreover, although the magnets 13 which are opposed one another and of which edges are cut off to form the tapered edges 13A, respectively, is employed, another type of magnet may be employed.

What is claimed is:

1. A method for generating an X-ray, comprising the steps of:

flattening an electron beam with a circular cross section by means of Lorentz force to form a flat electron beam with a flat cross section under the condition so that an intensity of said flat electron beam per unit area is set higher than an intensity of said electron beam per unit area; and irradiating said flat electron beam onto a target, thereby generating an X-ray, wherein said flat electron beam is made by passing said electron beam between a pair of rectangular magnets that oppose one another, edges of said rectangular magnets being cut off to form tapered edges, respectively configured so that said electron beam is introduced between said pair of rectangular magnets from said tapered edges, and wherein a fringing magnet field is generated at said tapered edges of said pair of rectangular magnets to be curved outward from said tapered edges so that said Lorentz force is applied vertically to said electron beam between said pair of rectangular magnets.

2. The generating method as defined in claim 1, wherein said target is a rotational target.

3. The generating method as defined in claim 2, wherein an irradiating portion of said flat electron beam in said rotational target is heated to a temperature near or more than a melting point of said rotational target to be partially melted, thereby generating said X-ray from said rotational target.

4. The generating method as defined in claim 3, wherein said flat electron beam is irradiated onto an inner wall of said rotational target so that a melted portion of said rotational target which are generated by irradiating said flat electron beam onto said rotational target are not splashed by a centrifugal force generated when said rotational target is rotated.

5. The generating method as defined in claim 1, wherein said target is disposed in an airtight container, and said X-ray is taken out of said airtight container via a given X-ray transparent film.

6. An apparatus for generating an X-ray, comprising:

an electron beam source for generating and emitting an electron beam;

a flat electron beam-generating means for flattening said electron beam with a circular cross section by means of Lorentz force to form a flat electron beam with a flat cross section so that an intensity of said flat electron beam per unit area can be set higher than an intensity of said electron beam per unit area; and a target for generating an X-ray by irradiating said flat electron beam thereon, wherein said flat electron beam-generating means is made by a pair of rectangular magnets that oppose one another, and of which edges are cut off to form tapered edges, respectively configured such that said electron beam is introduced between said pair of rectangular magnets from said tapered edges, and wherein said pair of rectangular magnets are configured such that a fringing magnetic field is generated at said tapered edges of said pair of rectangular magnets to be curved outward from said tapered edges so that said Lorentz force is applied vertically to said electron beam between said pair of rectangular magnets.

7. The generating apparatus as defined in claim 6, wherein said target is a rotational target.

8. The generating apparatus as defined in claim 7, wherein said rotational target is configured such that an irradiating portion of said flat electron beam in said rotational target is heated to a temperature near or more than a melting point of said rotational target to be partially melted, thereby generating said X-ray from said rotational target.

9. The generating apparatus as defined in claim 8, wherein said rotational target is configured such that said flat electron beam is irradiated onto an inner wall of said rotational target so that a melted portion of said rotational target which are generated by irradiating said flat electron beam onto said rotational target are not splashed by a centrifugal force generated when said rotational target is rotated.

10. The generating apparatus as defined in claim 6, further comprising an airtight container, wherein said target is disposed in said airtight container, and said X-ray is taken out of said airtight container via a given X-ray transparent film.

* * * * *